US009452102B2

(12) United States Patent
Ledea

(10) Patent No.: US 9,452,102 B2
(45) Date of Patent: Sep. 27, 2016

(54) MOBILITY WALKER WITH SPRING AND EXERCISE STRAPS

(71) Applicant: Roberto Ledea, Mira Loma, CA (US)

(72) Inventor: Roberto Ledea, Mira Loma, CA (US)

( * ) Notice: Subject to any disclaimer, the term of this patent is extended or adjusted under 35 U.S.C. 154(b) by 0 days.

(21) Appl. No.: 14/066,512

(22) Filed: Oct. 29, 2013

(65) Prior Publication Data

US 2015/0115556 A1 Apr. 30, 2015

(51) Int. Cl.

| | |
|---|---|
| ***B62B 5/00*** | (2006.01) |
| ***A61H 3/04*** | (2006.01) |
| ***A61H 3/00*** | (2006.01) |

(52) U.S. Cl.

CPC ..... *A61H 3/04* (2013.01); *A61H 3/008* (2013.01); *A61H 2201/0161* (2013.01); *A61H 2201/0192* (2013.01); *A61H 2201/1619* (2013.01); *A61H 2201/1628* (2013.01); *A61H 2201/1652* (2013.01)

(58) Field of Classification Search

CPC ..... A61H 3/04; A61H 3/008; A61H 3/00; A61H 2201/16; A61H 2201/1619; A61H 2201/1621; A61H 2201/1628; A61H 2201/163; A61H 2201/1633; A61H 2201/165; A61H 2201/1652; A61H 2203/0406; A61H 2203/0481; A61H 2203/0487; A63B 23/0464; A63B 23/10; A63B 21/1415

See application file for complete search history.

(56) References Cited

U.S. PATENT DOCUMENTS

| | | | | | |
|---|---|---|---|---|---|
| 1,402,179 | A * | 1/1922 | Piscitelli | A63B 21/0004 | 482/124 |
| 1,611,807 | A * | 12/1926 | Bergh | A61H 3/04 | 297/6 |
| 2,327,671 | A * | 8/1943 | Rupprecht | A61H 3/04 | 280/87.021 |
| 2,625,202 | A * | 1/1953 | Richardson | A61H 3/04 | 482/68 |
| 2,719,568 | A * | 10/1955 | Webb | A61H 3/008 | 2/69 |
| 3,721,437 | A * | 3/1973 | Skaricic | A61H 3/008 | 248/566 |
| 3,778,052 | A * | 12/1973 | Andow | A61H 3/008 | 135/67 |
| 4,621,804 | A * | 11/1986 | Mueller | A61H 3/04 | 135/67 |
| 6,578,594 | B1 * | 6/2003 | Bowen | A61H 3/008 | 135/67 |
| 6,935,353 | B2 * | 8/2005 | Hawkes | A61H 3/008 | 135/67 |
| 7,294,094 | B1 * | 11/2007 | Howle | A61H 3/00 | 135/67 |
| 8,784,284 | B1 * | 7/2014 | Smith | A47D 13/08 | 482/121 |
| 2004/0002407 | A1 * | 1/2004 | Hawkes | A61H 3/008 | 482/69 |
| 2012/0042917 | A1 * | 2/2012 | Workman | A61H 3/008 | 135/66 |

* cited by examiner

*Primary Examiner* — James M Dolak
(74) *Attorney, Agent, or Firm* — John R. Ross; John R. Ross, III

(57) ABSTRACT

A mobility walker. The mobility walker includes a removably attached lower section, middle section and upper section. Four wheels are connected to the lower section. A harness attachment spring is attached to the upper section. A user wearing the harness is attached via the harness to the harness attachment spring. The user is then able to walk, maneuver himself and exercise while utilizing the mobility walker.

12 Claims, 10 Drawing Sheets

MOBILITY WALKER WITH SPRING AND EXERCISE STRAPS

The present invention relates to medical devices, and, in particular, to mobility walkers.

BACKGROUND OF THE INVENTION

Mobility walkers are known in the prior art. They are used by individuals who have difficulty walking and supporting themselves safely. Elderly people who are feeble or young people who are injured are common users of mobility walkers. However, prior art walkers tend to be very bulky, cumbersome and expensive. They are difficult for healthy, strong people to maneuver and transport and are extremely challenging to a patient who needs support and assistance. Moreover, individuals who use prior art mobility walkers are often unable to exercise. They have difficulty moving without the walker. When they are using the walker they often feel confined to the walker and cannot exercise.

What is needed is a better mobility walker.

SUMMARY OF THE INVENTION

The present invention provides a mobility walker. The mobility walker includes a removably attached lower section, middle section and upper section. Four wheels are connected to the lower section. A harness attachment spring is attached to the upper section. A user wearing the harness is attached via the harness to the harness attachment spring. The user is then able to easily walk, maneuver and exercise while utilizing the mobility walker.

DETAILED DESCRIPTION OF THE PREFERRED EMBODIMENTS

Figure 2:
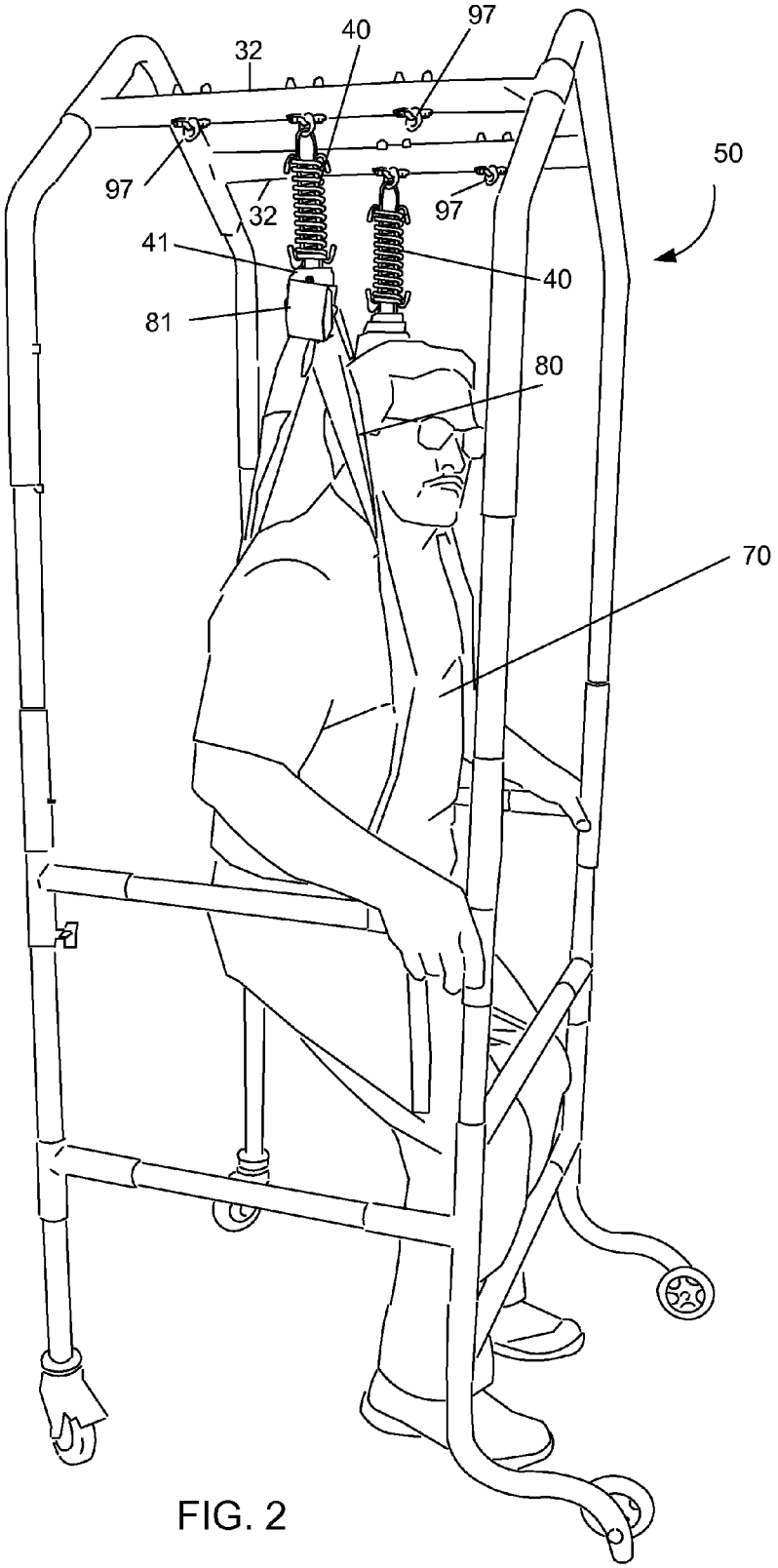
FIG. 2 shows a user utilizing a preferred mobility walker.

FIG. 2 shows a user utilizing preferred mobility walker 50. Mobility walker 50 is a light-weight; easy-to-use mobility walker that also allows the user to exercise his arms and legs while using the walker. Mobility walker 50 is easily assembled and then disassembled in a few minutes. The disassemble walker is easily transportable in the trunk of a small car. Further details of mobility walker 50 are discussed below.

Figure 1:
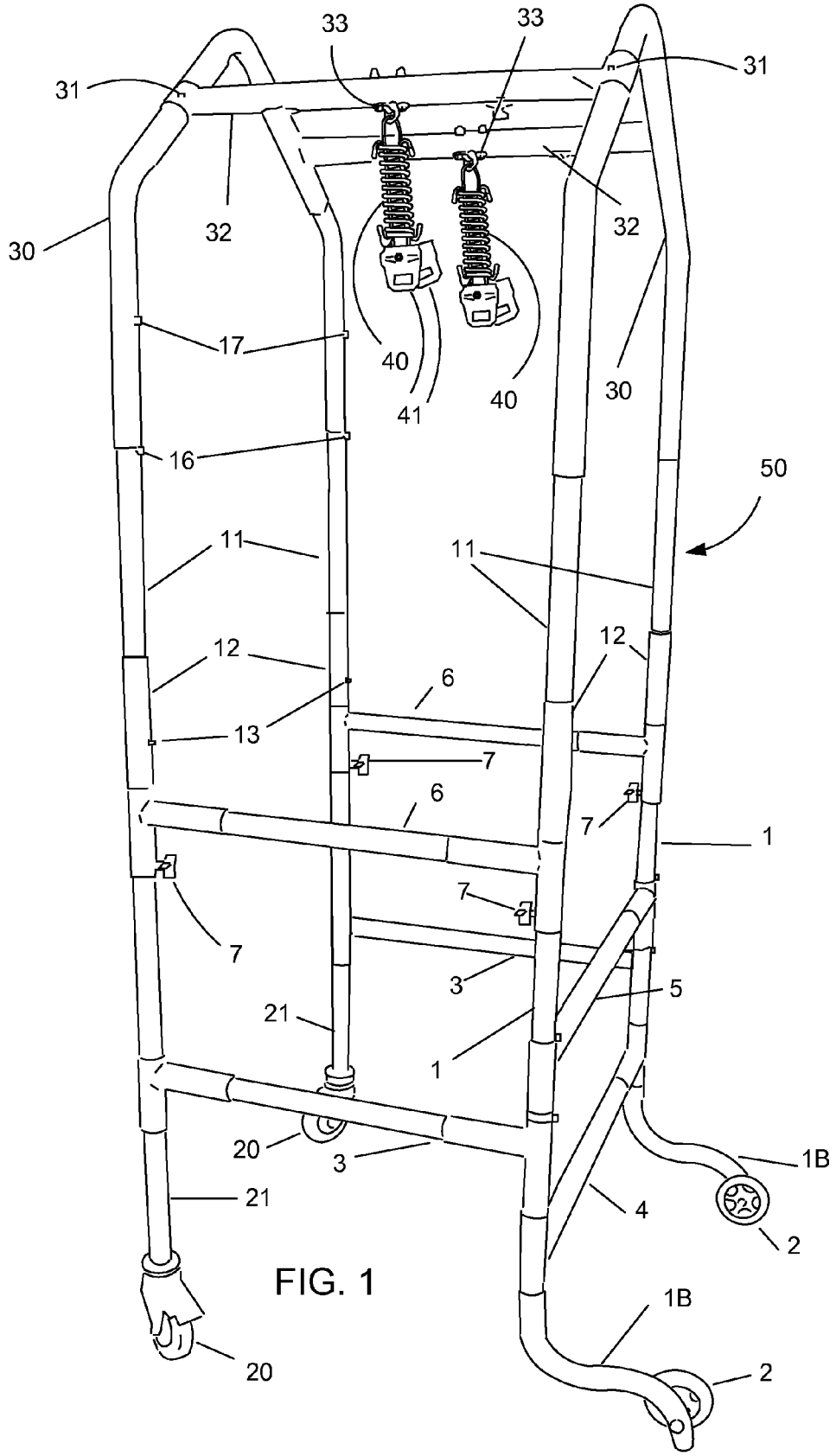
FIG. 1 shows a preferred embodiment of the present invention.
Figures 3, 4:
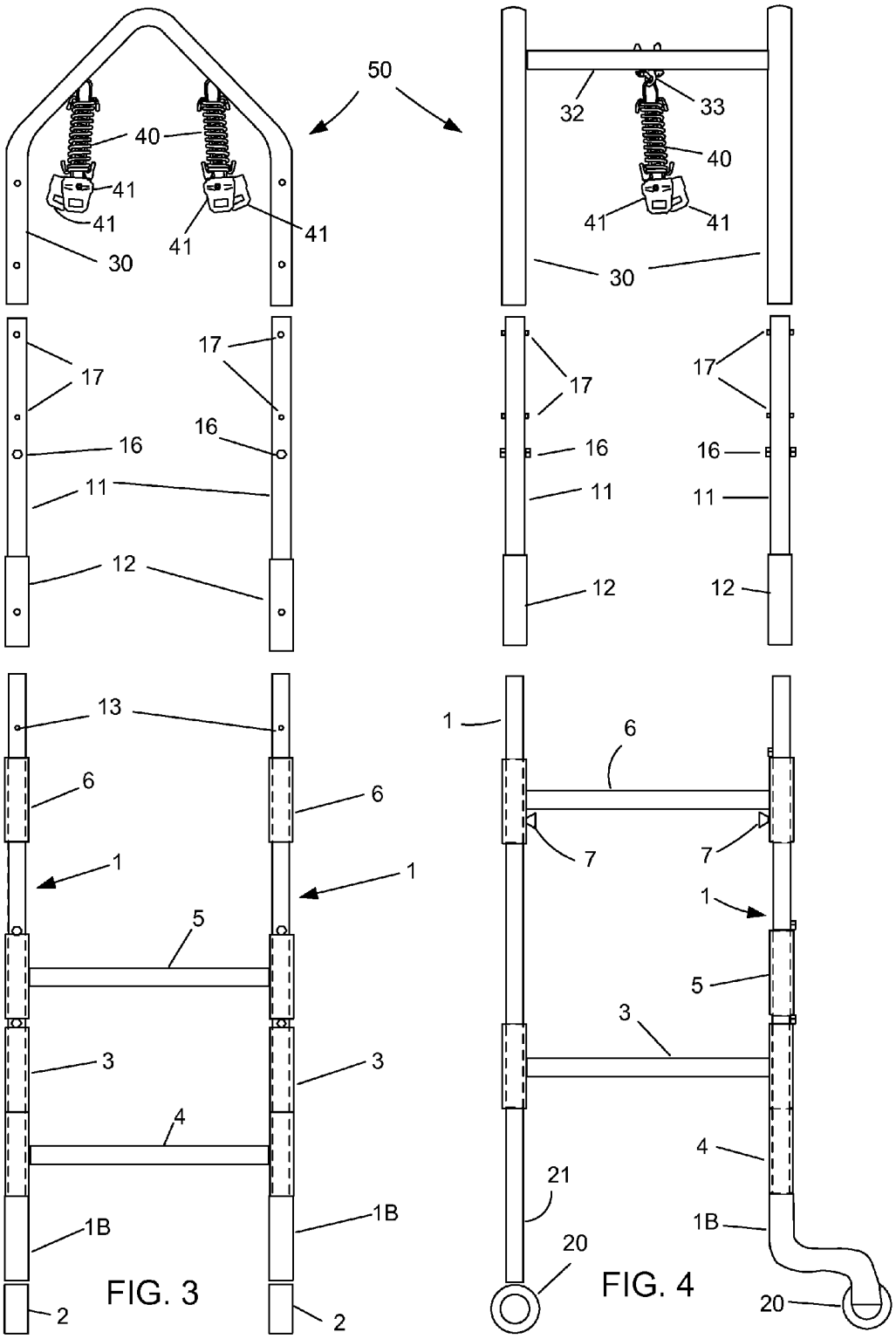
FIGS. 3 and 4 show an exploded view of a preferred embodiment of the present invention.

Preferred mobility walker 50 is shown in FIGS. 1 and 3-4. Mobility walker 50 is preferably fabricated from aluminum tubing. Lower front support tubes 1 are rigidly connected to lower outward extension section 1B. Lower outward extension section 1B preferably extends outward approximately 12 inches and allows for increased balance support for the user. In a preferred embodiment lower support tubes 1 have a height of approximately 35 inches. Wheels 2 are attached to lower outward extension section 1B as shown. Rear wheels 20 are pivotally connected to lower rear support tube 21. Lower support tube 1 extends through adjustable hand support bar 6, swivel bars 4 and 5 and lower support bar 3. Lower rear support tube 21 extends through lower support bar 3 and adjustable hand support bar 6. Lower support bar 3 is riveted to tube 21 and pivots about tube 1. Swivel bars 4 and 5 are pivotally attached to tube 1 as shown. Adjustable hand support bar 6 is positioned above swivel bar 5 and is held rigidly pinned to tubes 1 and 21 by utilization of threaded knobs 7. In a preferred embodiment, the height of adjustable bar 6 can be adjusted through a range of approximately 7 inches.

Middle support tubes 11 include rigidly attached cuff 12 as shown. In a preferred embodiment middle support tubes are approximately 25 inches long. Cuffs 12 are pin connected to tube 1 and tube 21 via spring loaded buttons 13. Middle support tubes 11 include stop buttons 16 and spring loaded buttons 17.

Upper arch section 30 is connected to middle support tubes 11 via spring loaded buttons 17. In a preferred embodiment arch section 30 extends upward approximately 24 inches. Cross bars 32 are removably attached to arch section 30 via screws 31. Cross bars 32 are preferably approximately 24 inches in length.

Springs 40 are connected to cross bars 32 via hooks 33 as shown. Springs 40 include male attachment buckle ends 41 for attachment of a user's support harness. Each spring 40 includes two male buckle ends 41.

Height Adjustment of Mobility Walker

Figure 5:
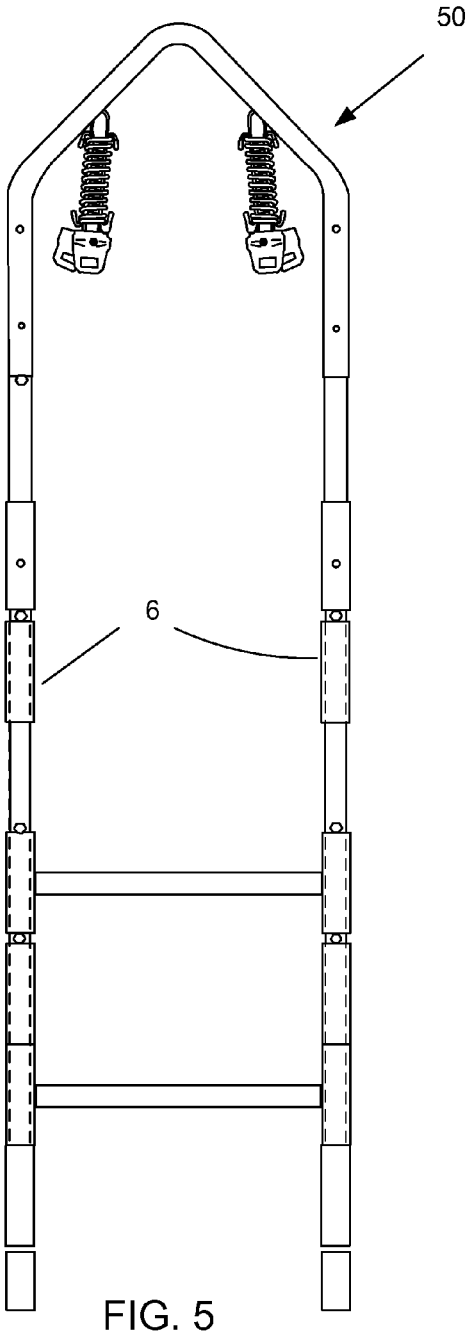
FIGS. 5 and 6 show a front and side view of a preferred mobility walker.
Figure 6:
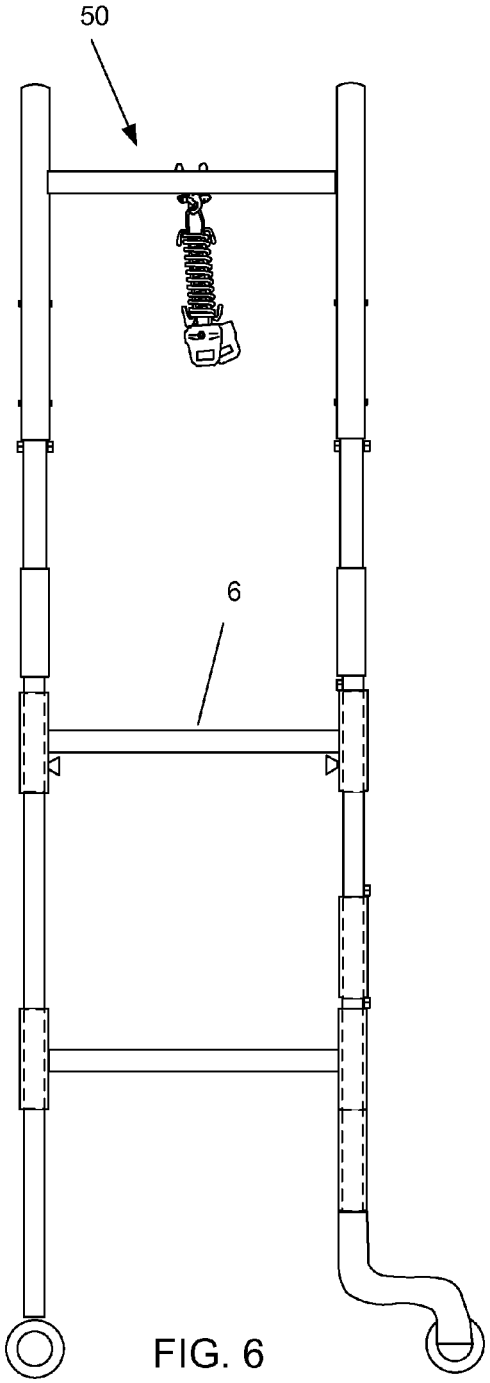
Figure 7:
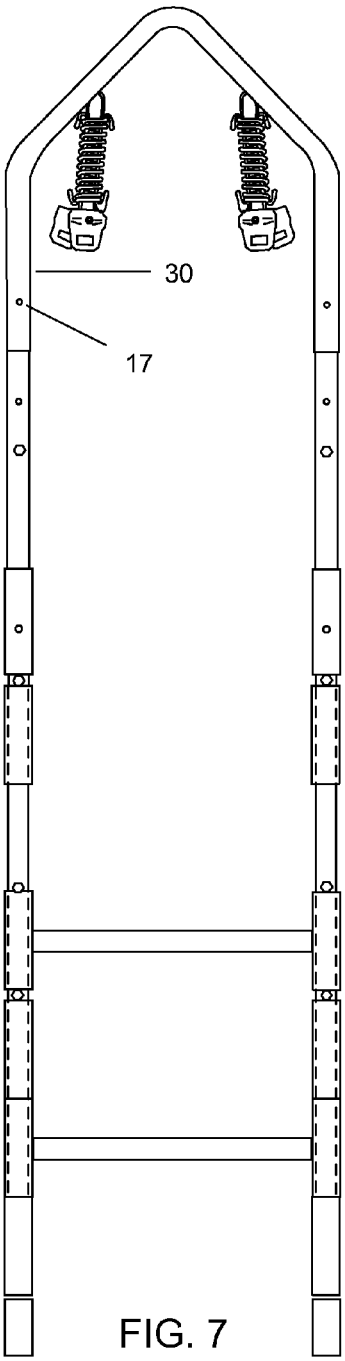
FIGS. 7 and 8 show a preferred mobility walker with extended height.
Figure 8:
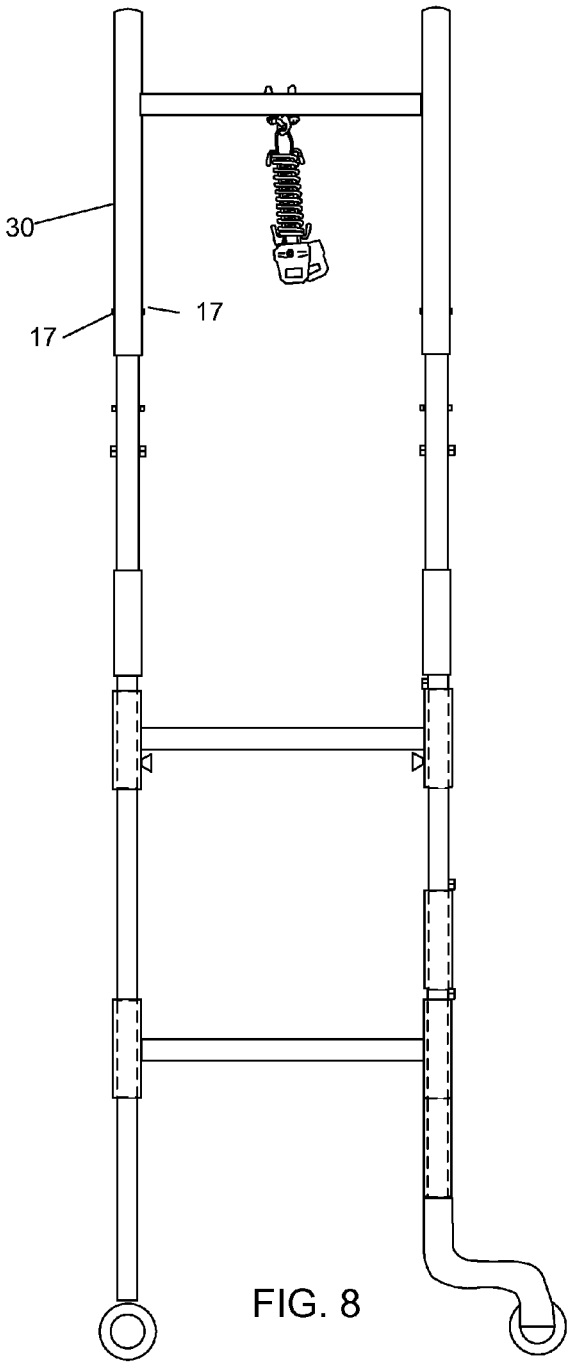
Figure 9:
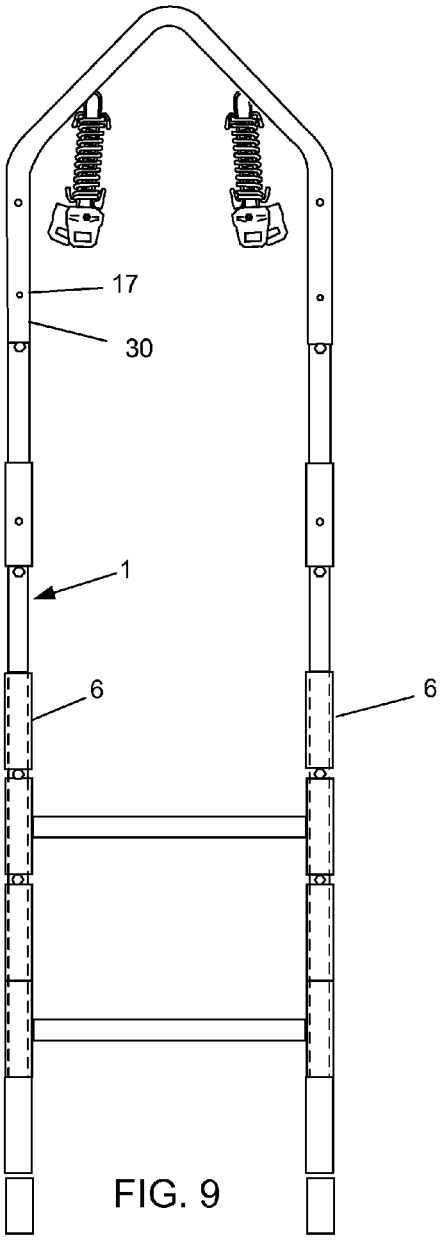
FIGS. 9 and 10 show a preferred mobility walker with lowered height.
Figure 10:
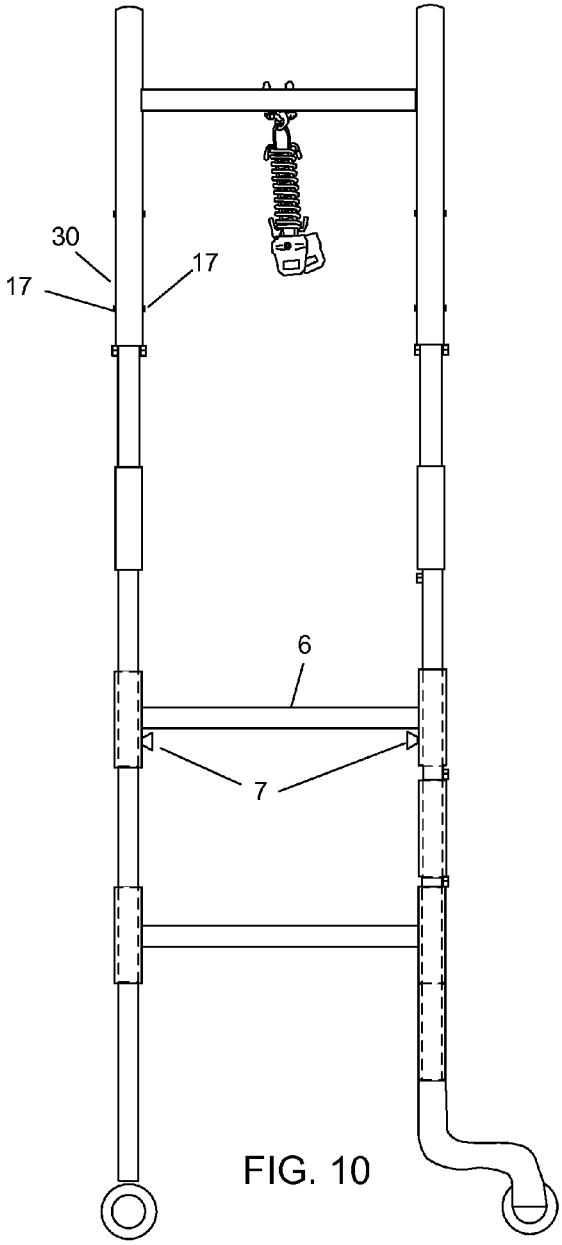

FIGS. 5 and 6 show a front view and side view of mobility walker 50 in the configuration depicted in FIG. 1. In a preferred embodiment of the present invention the height of mobility walker can be adjusted as well as the position of adjustable hand support bar 6. For example, in FIGS. 7 and 8, the height of arch section 30 has been raised approximately 7 inches and arch section 30 is held securely in place by utilization of spring loaded buttons 17. The position shown in FIGS. 7-8 would be ideal for a tall man over 6 feet tall. In FIGS. 9 and 10, the height of arch section 30 has been lowered back down and arch section 30 is held securely in position by utilization of the lower spring loaded buttons 17. Also in FIGS. 9 and 10 the position of adjustable hand support bar 6 has been lowered approximately 5 inches. Adjustable hand support bar 6 is shown securely held in position by utilization of knobs 7. The position of mobility walker shown in FIGS. 9-10 would be ideal for a very short adult or a typical 12 year old child.

Assembly, Disassembly and Transportation of Mobility Walker

Figure 11:
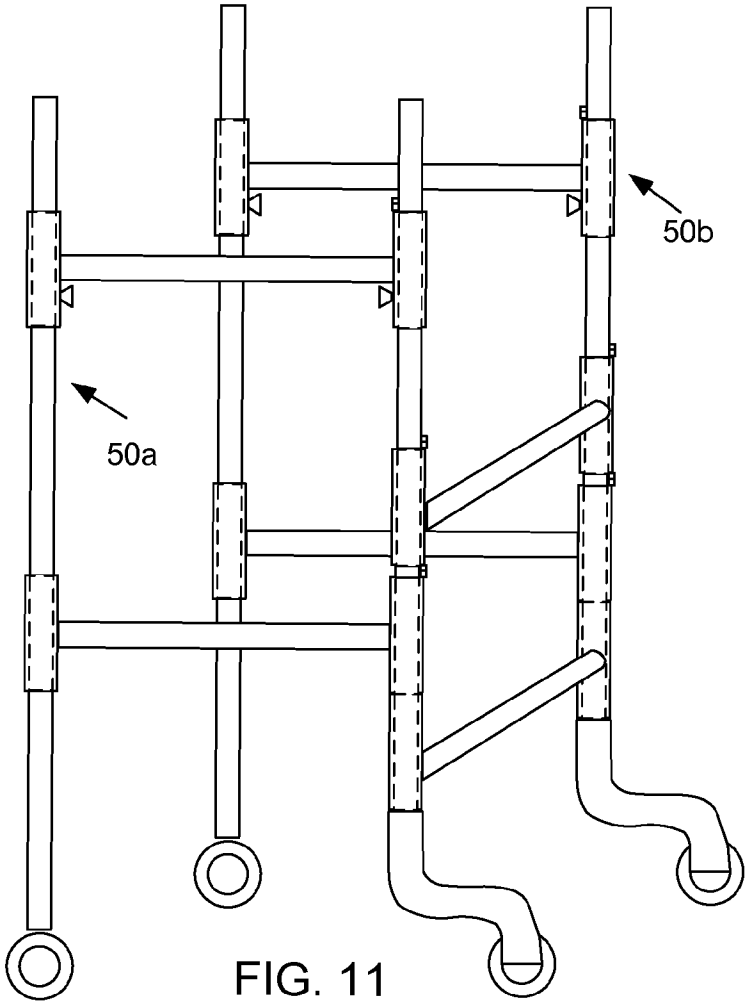

Mobility walker 50 is easily assembled, disassembled and transported. To assembly the mobility walker, the user connects the pieces together as shown in FIG. 1 and the exploded view shown in FIGS. 3 and 4. To disassemble mobility walker 50, the user first removes arch section 30. The user may then further disassemble arch section 30 by removing springs 40 and then unscrewing and removing cross bars 32. The user then removes middle support tubes 11 from tubes 21 and 1. Mobility walker 50 will then appear as shown in FIG. 11 showing pivotally connected lower sections 50*a* and 50*b* of lower section 50L. Lower sections 50*a* and 50*b* are pivotally connected so lower section 50L can be folded for easy and quick transport and stowage.

Figure 12:
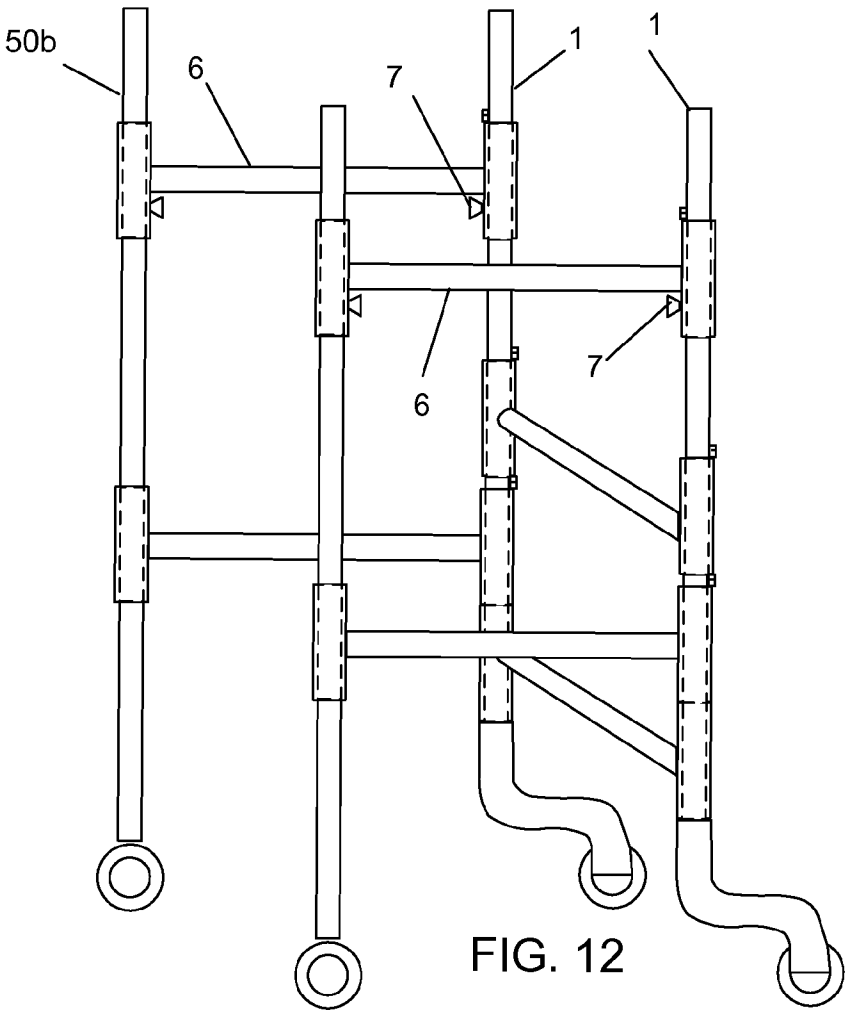
FIGS. 11-14 show a preferred method for collapsing and transporting the lower section of a preferred mobility walker.

In FIG. 12 the user has loosened knobs 7 allowing adjustable hand support bar 6 to now pivot freely about tube 1. The user has begun to push lower section 50*b* to the left.

Figure 13:
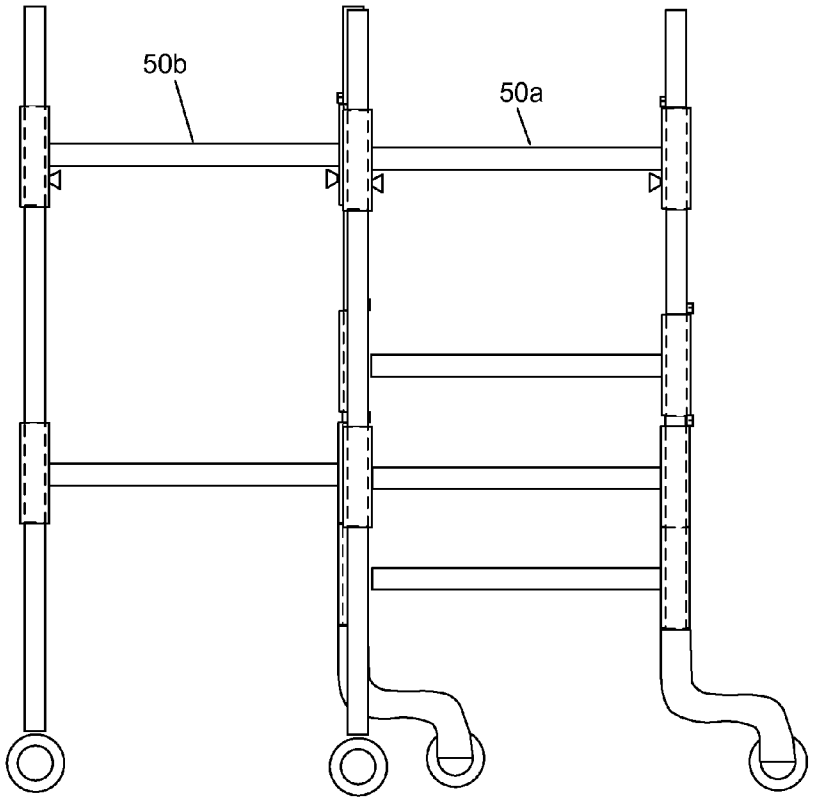

In FIG. 13 the user has finished pushing lower section 50*b* to the left.

Figure 14:
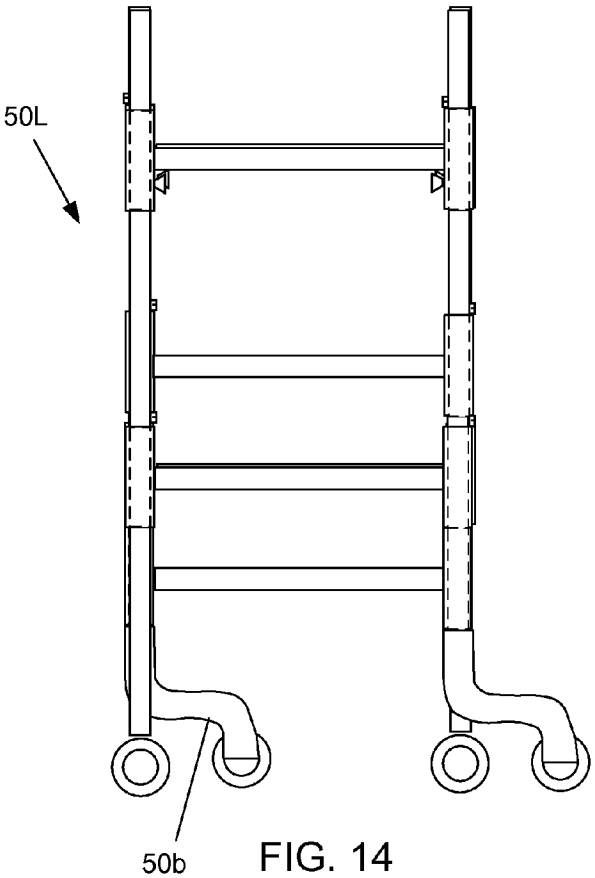

In FIG. 14 the user has pivoted lower section 50*b* so that it appears in the collapsible position as shown. Lower section 50L is now ready for easy transport.

Utilization of the Mobility Walker

The Harness

Figure 15:
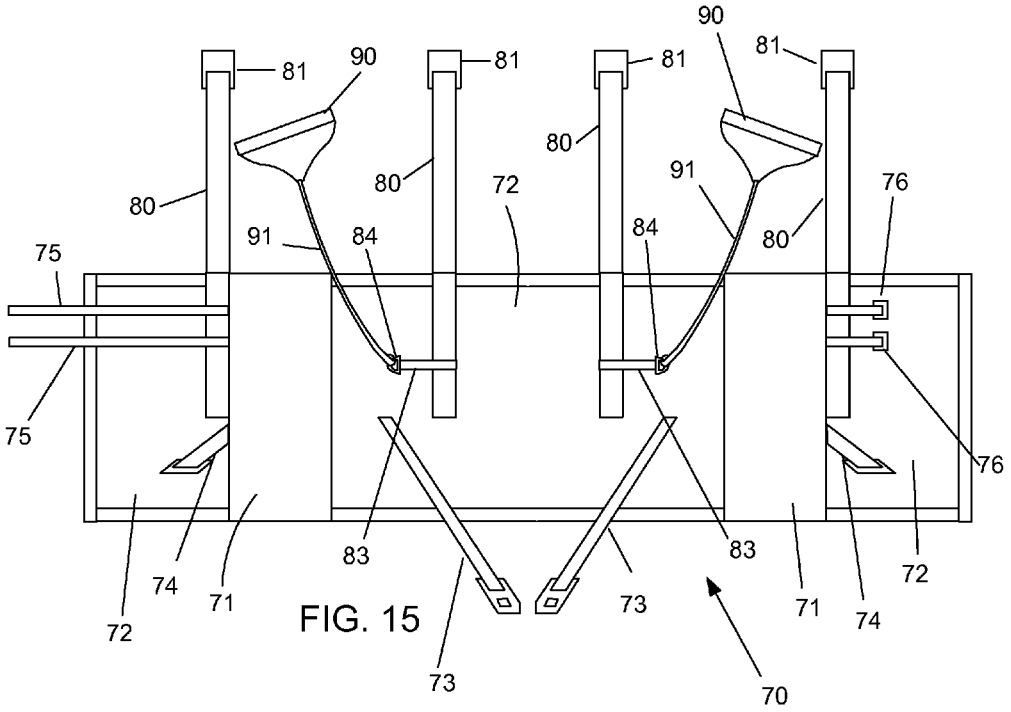
FIG. 15 shows a preferred harness.

FIG. 2 shows a user connected to mobility walker 50 via harness 70. A preferred harness 70 is shown in FIG. 15. Neoprene stretch material sections 71 are sewn between heavy duty canvas material sections 72. Belts 73 with male attachment ends extend through the user's legs and connect with belts 74 having female attachment ends. Straps 75 wrap around the user's chest and then are secured tight with buckles 76. Belts 80 extend upward as shown and include female buckle ends 81.

Harnessing of User to Mobility Walker

FIG. 2 shows a user harnessed correctly to mobility walker 50 via harness 70. Female buckles 81 of harness 70 are connected to male buckle 41 of spring 40. The user is now suspended from cross bars 32 by springs 40. He is supported and able to walk comfortably. Springs 40 allow for optimum comfort and allow the user to move up and down to exercise and strengthen his legs.

Additional Exercise Straps

As shown in FIG. 15, back straps 83 are sewn onto canvas section 72. Back straps 83 include exercise device attachment rings 84. In a preferred embodiment an exercise device is connected to rings 84 to allow the user to exercise while using mobility walker 50. For example, FIG. 15 shows elastic bands 91 connected to rings 84. Handles 90 are connected to the ends of elastic bands 91. In a preferred embodiment, a user may exercise his arm muscles by grabbing and pulling handles 90 while band 91 stretches as its attached to rings 84. Additionally, the user can connect exercise devices to hooks 97 attached to cross bar 32. For example, the user can connect band 91 with handle 90 to hooks 97 and pull downward to strengthen other muscle groups in his arms.

Lazy Susan Bearing

Figure 18:
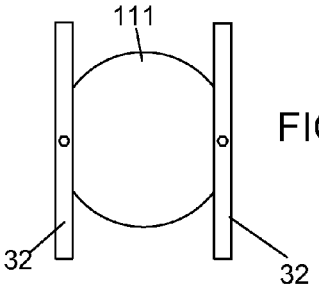
FIGS. 16-18 show another preferred embodiment of the present invention that includes a Lazy Susan bearing.
Figure 16:
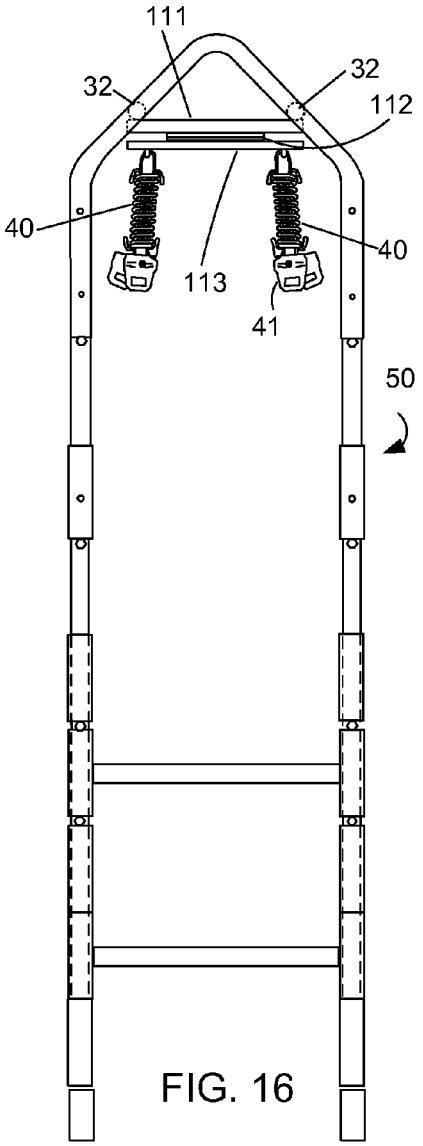
Figure 17:
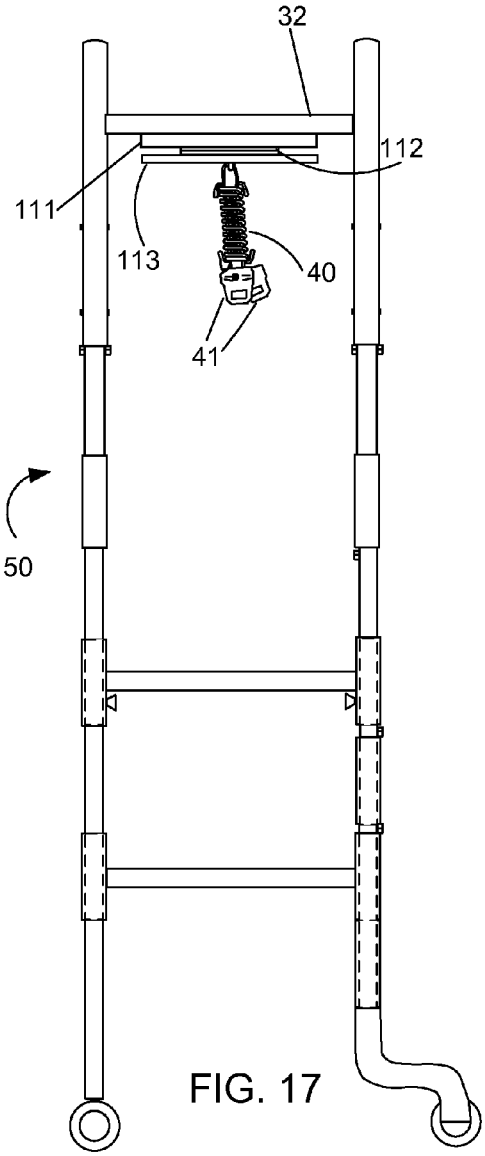

Another preferred embodiment of the present invention is shown in FIGS. 16-18. Circular platform 111 is bolted to the underside of cross bars 32. Lazy Susan bearing 112 is connected between circular platform 111 and circular support platform 113. Springs 40 having male buckle ends 41 are connected to the underside of support platform 113 as shown. Lazy Susan bearing 112 allows support platform 113 to rotate freely 360 degrees while circular platform 111 remains stationary. Hence, Lazy Susan bearing 112 allows for the 360 degree rotation of springs 40. Therefore, a user attached to springs 40 will be able to rotate his position as desired without having to adjust the position of mobility walker 50.

Although the above-preferred embodiments have been described with specificity, persons skilled in this art will recognize that many changes to the specific embodiments disclosed above could be made without departing from the spirit of the invention. Therefore, the attached claims and their legal equivalents should determine the scope of the invention.

What is claimed is:

1. A mobility walker, comprising:

A. a removably attached lower section, comprising a plurality of wheels,

B. a removably attached middle section,

C. a removably attached upper section,

D. two lower front support tubes,

E. two lower rear support tubes,

F. two lower outward extension sections connected to said two lower front support tubes, G. two swivel bars, each said swivel bar pivotally connected to both of said two lower front support tubes, H. two lower support bars, each lower support bar pivotally connected to one of said two lower front support tubes, each lower support bar rigidly connected to said one of said two lower rear support tubes, I. two adjustable hand support bars, each adjustable support bar connected to one of said two lower front support tubes, each lower support bar connected to said one of said two lower rear support tubes, J. two adjustment knobs connected to each of said two adjustable hand support bars, the first of said adjustment knobs for adjusting tension on one of said two lower front support tubes, the second of said adjustment knobs for adjusting tension on one of said two lower rear support tubes, wherein said plurality of wheels comprises:

K. two rear wheels pivotally connected to said two lower rear support tubes,

L. two front wheels rotatably connected to said two lower outward extension sections M. at least one harness attachment spring attached to said removably attached upper section, and N. a harness connected to said at least one spring wherein a user is wearing said harness and is able walk, maneuver, and exercise while utilizing said mobility walker.

2. The mobility walker as in claim 1, wherein said plurality of wheels comprises:

A. two rear wheels pivotally connected to said walker, and

B. two front wheels rotatably connected to said walker.

3. The mobility walker as in claim 1, further comprising:

A. two adjustable hand support bars connected to said removably connected lower section, and B. two adjustment knobs connected to each of said two adjustable hand support bars, wherein the height of said adjustable hand support bars is adjustable by adjusting the tension of said two adjustment knobs.

4. The mobility walker as in claim 1, wherein said removably attached middle section comprises four middle support tubes, each connected to said removably attached lower section via a rigidly attached cuff.

5. The mobility walker as in claim 4, wherein each of said four middle support tubes comprises a plurality of spring loaded buttons for allowing for adjustable height of said removably attached upper section.

6. The mobility walker as in claim 1, wherein said removably attached upper section comprises:

A. two upper arch sections, and

B. two cross bars connected between said two upper arch sections, wherein said at least one harness attachment spring is two harness attachment springs, wherein each of said two harness attachment springs is suspended from each of said two cross bars.

7. The mobility walker as in claim 1, wherein said at least one harness attachment spring is two harness attachment springs, where each of said harness attachment springs comprises two spring buckle ends for connection to said harness.

8. The mobility walker as in claim 7, wherein said harness comprises four harness buckle ends for connection to said spring buckle ends.

9. The mobility walker as claim 1 further comprising an exercise device connected to said harness for utilization by the user of said mobility walker.

10. The mobility walker as in claim 1, further comprising an exercise device connected to said mobility walker.

11. The mobility walker as in claim 1, wherein said removably attached lower section is collapsible and transportable.

12. The mobility walker as in claim 1, wherein said mobility walker is easily assembled and disassembled.

* * * * *